United States Patent [19]

Lewis

[11] 4,011,835

[45] Mar. 15, 1977

[54] TONER CONVEYOR

[75] Inventor: William G. Lewis, Rochester, N.Y.

[73] Assignee: Xerox Corporation, Stamford, Conn.

[22] Filed: May 25, 1976

[21] Appl. No.: 689,752

[52] U.S. Cl. ..... 118/652; 355/3 DD

[51] Int. Cl.[2] ..... G03G 15/00

[58] Field of Search ..... 118/637; 355/3 R, 3 DD, 355/15

[56] References Cited

UNITED STATES PATENTS

| | | | |
|---|---|---|---|
| 3,678,896 | 7/1972 | Hewitt | 118/637 |
| 3,724,725 | 4/1973 | Stauffer | 118/637 |
| 3,752,576 | 8/1973 | Gerbasi | 355/3 DD |
| 3,825,936 | 7/1974 | Ott et al. | 118/637 |

*Primary Examiner*—Henry S. Jaudon

[57] ABSTRACT

A toner conveyor comprising a plurality of helical springs joined together to form an endless train movable through a tube, the train having nested therein at spaced intervals, a plurality of floats which form in combination with the tube a plurality of chambers for moving toner.

9 Claims, 2 Drawing Figures

TONER CONVEYOR

BACKGROUND OF THE INVENTION

This invention relates to xerographic apparatus and, in particular, to an arrangement for moving toner from one place to another in a xerographic machine.

In the art of xerography, a xerographic plate, which is formed on a conductive backing upon which is placed a photoconductive insulating material is charged uniformly in the surface of the plate and subsequently exposed to a light image of the original to be reproduced. The photoconductive coating is thereby caused to become conductive under the influence of the light image so as to selectively dissipate the electrostatic charge found thereon thus producing an electrostatic latent image. The latent image is made visible by developing it with any one of a variety of pigmented resins which have been specifically developed for this purpose. In the xerographic process, the pigmented resin material, or toner, is electrostatically attracted to the latent image on the photoconductive surface in proportion to the amount of charge found thereon. Areas of small concentration become areas of low toner density while areas of greater charge concentration become proportionally more dense. The fully developed image is then transferred from the plate surface to the final support material, as for example, paper, and is fixed thereto to form a permanent record of the original copy.

A preponderance of the toner material is transferred from the photoconductive surface to the final support material during the transfer operation. However, it has been found that forces bonding some of the toner particles to the photoconductive surface are stronger than the transfer forces involved and, therefore, some particulate material remains on the photoconductive surface after the xerographic image is transferred. This residual toner, if cleaned from the xerographic plate in some manner, will have a deleterious effect on subsequent images processed on the plate.

Plate cleaning in automatic xerographic machines in which the plate is continually reused in the xerographic process is accomplished by various devices such as fiber brushes, cleaning webs, wiper blades or the like. The toner material so removed may be collected and stored in the machine and then periodically removed and discarded. Alternatively, collected toner may be returned from the cleaning station of the machine to the development housing for reuse in the development process. This returning of toner may be done manually by first collecting the cleaner toner in a container at the cleaning station and later dumping the contents of this container into the developer sump.

A system for automatically recovering residual toner and returning it to the developer housing for reuse in the development zone is described in U.S. Pat. No. 3,752,576 and U.S. Pat. No. 3,678,896 in which an endless bead chain conveyor moves between the cleaning station and the development station of a xerographic system. As provided in the cleaning systems shown in the above-noted patents, toner cleaned from the xerographic plate at the cleaning station is moved from the cleaning station to the developer station by means of a bead chain conveyor and deposited into the sump of the development unit for reuse in the development process. The above-noted bead chain conveyor has proved unsatisfactory due to binding of toner in the small clearances of the bead chain and packing of toner within the hollow spheres.

This invention is directed to an alternative conveying arrangement usable in the environment shown in the above noted patents for moving toner from a cleaning station of a xerographic machine back to a development station for reuse.

OBJECTS & SUMMARY OF THE INVENTION

It is, therefore, an object of this invention to improve xerography, and in particular, automatic xerographic reproducing apparatus.

A further object is to provide a more efficient and and reliable arrangement for conveying powder materials from place to place in a xerographic processor.

These and other objects and advantages of the invention are accomplished by means of a toner conveyor comprising a plurality of helical springs joined together to form an endless train movable through a tube, the train having nested therein at spaced intervals, a plurality of floats which form in combination with the tube a plurality of chambers for moving toner.

For a better understanding of the invention as well as other objects and further features thereof, reference is had to the following detailed description of the invention to be read in connection with the accompanying drawings.

DESCRIPTION OF THE PREFERRED EMBODIMENTS

Figure 1:
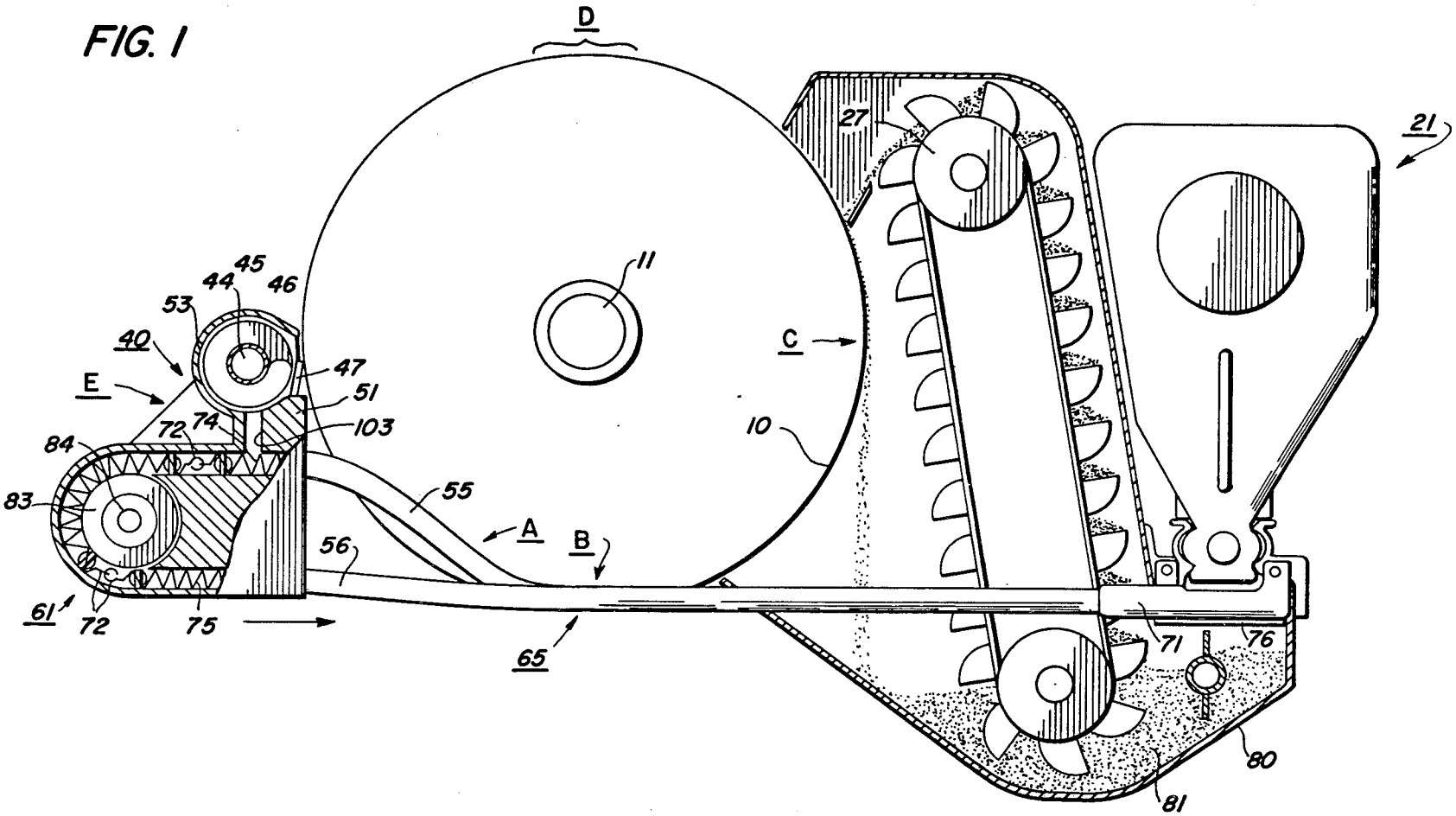
FIG. 1 shows pertinent portions of an automatic xerographic reproducing apparatus with a prior art cleaning system modified to incorporate the conveyor arrangement of the present invention.
Figure 2:
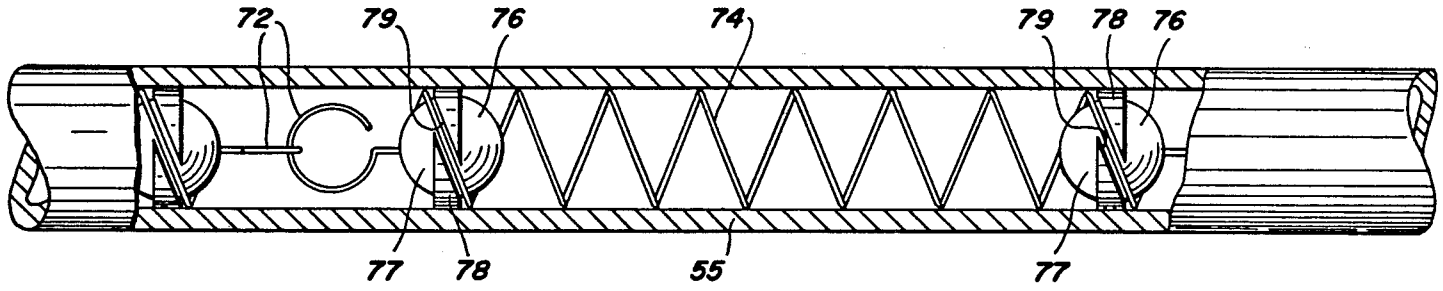
FIG. 2 is a side elevation showing the details of the filter arrangement with the conveyor conduit broken away to expose the details of the conveyor.

Referring to the drawings, the invention is shown in FIG. 1 as part of a well known xerographic copy machine comprising a xerographic plate including a photoconductive layer of a light receiving surface on a conductive backing and formed in the shape of a drum, generally numerically designated 10 which is journaled in the frame of the machine by means of shaft 11. The xerographic plate is rotated in the direction indicated in FIG. 1 to cause the drum surface to pass sequentially through a plurality of xerographic processing stations.

For the purpose of the present disclosure, several xerographic processing stations in the path of movement of the drum surface may be described functionally as follows:

A charging station A, in which a uniform electrostatic charge is deposited on the photoconductive layer of the xerographic drum;

An exposure station B wherein a light or radiation pattern of an original document to be reproduced is projected onto the drum surface to dissipate the charge found thereon in the exposed areas to form a latent electrostatic image;

A development station C, at which a xerographic developing material having toner particles possessing an electrostatic charge opposite to the charge found on the drum surface in the latent images are moved from a sump area 81 in the bottom of a developer housing 80 by a bucket type conveyor 27 and cascaded over the moving drum surface whereby the toner particles adhere to the electrostatic latent image to make visible the image in the configuration of the original document to be reproduced. A toner container 21 is mounted in an opening above the sump and activated at preselected intervals to replenish the toner used in the development process.

A transfer station D, in which the xerographic powder image is electrostatically transferred from the drum surface to a final support material; and A drum cleaning and toner collection station E, wherein the drum surface is first charged and then wiped with a doctor blade to remove residual toner particles remaining thereon after image transfer and wherein the removed toner is collected for re-use in the xerographic process and in which the drum surface is exposed to an incadescent panel to effect substantially complete discharge of any residual electrostatic charge remaining thereon.

Detailed descriptions of the operation and construction of the various processing stations is well known in the art, as exemplified by U.S. Pat. Nos. 3,678,896 and 3,752,576. For this reason, only a description of those portions of the system pertinent to the invention will be presented in more detail.

The invention is incorporated into the cleaning station of the type shown in FIG. 1 which operates to remove substantially all residual toner particles remaining on the xerographic drum surface after image transfer and recovers the residual toner as removed for re-use in the automatic reproducing apparatus in a manner to be described below. The cleaning station comprises a rectangularly shaped flexible blade 47 to remove residual toner from the moving drum surface. The blade extends along the width of the drum and is mounted in a blade holder 51 forming one wall of cleaning and collection apparatus 40 (FIG. 1). The blade normally rests transversely in pressure contact with the photoconductive layer on the drum surface. The blade is positioned so that its contacting edge cuts or chisels toner material from the drum surface.

Because of the blade's novel cleaning action, the toner particles are cut cleanly from the plate surface and are allowed to fall freely into the collecting trough provided. As a result, the toner particles substantially retain their integrity throughout the cleaning process and are therefore in a condition to be immediately re-used in the xerographic process without recourse to further treatment of processing thereof. Suitable materials out of which the blade may be constructed are described in the aforementioned patent.

By positioning the doctor blade 47 slightly below the horizontal center line of the drum surface and providing the blade with a light back rack, the removed residual toner material is forced to fall to the backside of the blade, that is, to the side away from the photoconductive drum surface and into an open sided channel 53 adjacent to and running longitudinally along the drum surface. A screw type conveyor 45 comprising a shaft 44 which carries a spiral thread 46 is supported for rotation in the channel 53 in substantially parallel relation to the doctor blade. The open sided channel 53 is closed at one end (not shown) while the opposite end of the channel communicates with a toner drop tube 103. The conveyor 45 and channel 53 cooperate to convey the toner particles removed from the drum surface towards and into the tube 103.

Referring to FIG. 1, toner conveyor of this invention is seen to comprise a conduit arrangement 65 including a supply conduit or tube 55 and a return conduit 56. The conduit arrangment 65 is connected to convey removed toner between a cleaning station terminal 61 and a developer station terminal 71. The terminals 61 and 71 and tubes 55 and 56 are connected together so that a continuous substantially closed circuit conduit having a substantially uniform inside diameter runs from the cleaning station to the development station and back again.

The tubes 55 and 56 are circular in cross-section and may be made of any suitable plastic or metal. The inside diameter of the tubes is selected to accomodate an endless chain or conveyor or as will be described in greater detail hereinafter. The terminals 61 and 71 are constructed to form a continuation of the tunnels or passages provided by the tube 55 and 56.

An endless chain or conveyor 75 rides in the conduit arrangement 65. The conveyor 75 comprises a plurality of helical springs 74 each having hooks 72 or other suitable means formed on opposite ends thereof which interlock with each other to form the springs into an endless train. The springs may be formed of wire and may be round or square in cross section.

Each spring supports one or several metal or plastic discs or floats 76 so as to form a chamber between adjacent floats for moving toner along the tubes. The floats 76 include a spherical central portion 77 and a support disc portion 78 outwardly of the spherical portion and formed integral therewith. The support disc portion of each float is provided with a notch 79 which fits over a portion of the spring to loosely couple the float to its associated spring. This latter arrangement permits movement of the floats with the spring down the tubes and proper orientation on the float during such movement.

Adjacent floats form therebetween a cavity or container in which toner to be moved is trapped during movement through the conduit arrangement.

The chain 75 is moved by means of a windlass or pulley 83 mounted on a shaft 84 driven by a suitable motive device (not shown). The pulley 83 is shown located in the cleaning station terminal 61 but may be located in the development station terminal 71. Alternately, a driven windlass may be located in each of the terminals 61 and 71. The frictional engagement of the outer surface of the springs with the pulley serves to drive the springs 74 in the direction indicated to thereby advance the chain 75 along a path past the drop tube 103 at which removed toner is gathered for return back to the developer sump 81.

There are several alternatives for selecting the relative diameters of the springs, tube passages, and floats. The float is always selected to have an outside diameter which permits it to fit snugly inside the tubes 55 and 56. More specifically, the float diameter is selected so that the float may move with facility down the tube in an orientation perpendicular to the axis of the tube and with a sufficiently small space between the outer edges of the float and the inside of the tubes to prevent ready escape of toner therethrough. This permits the float to push toner down the tube in the direction of movement of the conveyor.

With regard to the relative diameter of the springs and tube several alternatives are possible, each having a particular advantage.

A first alternative is to select the diameter of the spring or a portion thereof in a relaxed state to be greater than the inside diameter of the tubes. Under these circumstances the spring must first be put under tension to reduce its diameter prior to inserting it in the conduit arrangement. This alternative has the advantage of providing a scraping action of the spring on the inner walls of the tubes thereby ensuring more complete movement of all residual toner. Only a short length of the spring or short sections along its length need be provided with this increased diameter, so as to limit the frictional resistance between the springs and the tube. Too large a resistance would render the spring conveyor difficult to move through the conduit.

Another alternative is to select the spring to have a relaxed outer diameter which snugly fits into or is substantially smaller than the inside diameter of the tube with the spring in the relaxed state. This arrangement has the advantage that during operation when the sprint is under tension, it decreases in diameter and thereby moves out of contact with the tube wall. This permits more smooth movement of the springs along the tube and a smaller driving force for the windlass.

The terminal 71 includes an opening (not shown) which permits the toner being returned to the developer station to drop by gravity into the sump 81.

It is also possible to form the conveyor of a single continuous helical spring of sufficient length to run the length of the conduit arrangement with opposite ends thereof being hooked together to form an endless loop.

While the invention has been described for use with cascade type development systems, it would be equally applicable to systems employing any of the other conventional development systems such as magnetic brush or fur brush.

While this invention has been described in conjunction with specific embodiments thereof, it is evident that many alternatives, modifications and variations are apparent to those skilled in the art. Accordingly, it is intended to embrace all alternatives, modifications and variations that fall within the scope of the appended claims.

What is claimed is:

1. In an apparatus for returning the residual toner remaining on a photoconductive surface after image transfer to a remote developer station for reuse in the xerographic developer process wherein residual particulate toner is removed from the photoconductive surface at a cleaning station, collected by a collection means, and returned by a tubular conduit connecting said collection means and the developer station, an endless conveyor means arranged to be driven sequentially through said tubular conduit past said collection means and developer station, the improvement in which said endless conveyor means comprises an endless helical spring means and a plurality of floats nested in said spring means for pushing developer along said tubular conduit.

2. The combination recited in claim 1 wherein said spring means comprises a plurality of helical springs, each spring having formations on the ends thereof suitable for joining with ends of adjacent springs to form an endles train.

3. The combination recited in claim 2 wherein said floats have a peripheral shape which conforms to the inner periphery of said conduit, and snugly fit within said conduit to substantially traverse said cross-section of said conduit.

4. The combination recited in claim 3 wherein floats include formations which loosely couple said floats to said spring means.

5. An apparatus for conveying a powder from a first location to a second location comprising:

an endless conduit, said conduit having a powder collecting opening associated with said first location and a discharge opening associated with said second location, an endless conveyor in said conduit comprising spring means, and float means nested in said spring means for substantially traversing the cross sectional area of said conduit to thereby move developer along said conduit during movement of said spring means, and means for moving said conveyor through said conduit.

6. The apparatus of claim 5 wherein said spring means comprises a plurality of helical springs jointed together to form an endless train.

7. The apparatus of claim 6 wherein said floats substantially traverse the cross section of said conduit.

8. The apparatus of claim 5 wherein said spring means has an outside dimension, when in a relaxed condition, which is greater than the inside diameter of said conduit.

9. The combination recited in claim 5 wherein said means for moving comprises a driven pulley around which said conveyor moves.

* * * * *